United States Patent [19]

Panetta

[11] 4,113,020

[45] Sep. 12, 1978

[54] FIRE SAFETY CHRISTMAS ORNAMENT

[76] Inventor: Anthony Panetta, 39 Conkling St., Basking Ridge, N.J. 07920

[21] Appl. No.: 749,608

[22] Filed: Dec. 13, 1976

[51] Int. Cl.[2] ..... A62C 35/02

[52] U.S. Cl. ..... 169/26

[58] Field of Search ..... 169/26, 29, 65; 220/89 B

[56] References Cited

U.S. PATENT DOCUMENTS

| | | | |
|---|---|---|---|
| 1,063,228 | 6/1913 | Thornton | 169/29 |
| 2,945,583 | 7/1960 | Sire | 220/89 B X |
| 3,132,695 | 5/1964 | Peltier | 169/26 |
| 3,710,855 | 1/1973 | Osorio | 169/26 |
| 3,884,306 | 5/1975 | Williams | 169/65 X |

*Primary Examiner*—Joseph F. Peters, Jr.
*Assistant Examiner*—Michael Mar
*Attorney, Agent, or Firm*—Michael J. Ram

[57] ABSTRACT

The invention consists of a Christmas tree ornament which contains a fire extinguishing powder. When the ornament is exposed to an elevated temperature such as a flame heat sensitive adhesive holding the ornament together softens and a spring within the ornament forces it apart releasing the powder thus extinguishing the flame.

5 Claims, 4 Drawing Figures

FIRE SAFETY CHRISTMAS ORNAMENT

SUMMARY AND OBJECTS OF THE INVENTION

The invention relates to a decorative Christmas tree ornament which also functions as a fire extinguisher.

It is an object of the invention to provide an inexpensive ornament with fire extinguishing capabilities. It is a further object to provide such an ornament which is simple, easy to manufature and, in outward appearance, is not different from ornaments without fire extinguishing capabilities.

The present invention consists of a standard type Christmas tree ornament composed of two pieces, such as a globe or bell shape. In the case of a bell ornament the bell would be one piece and a filler in the base thereof would be the second piece. A ball would be composed of two spherical shell halves. The pieces are joined and sealed together at at least two points by the application of a small amount of an adhesive, such as a hot melt glue, adhesive or wax, applied to the juncture between the pieces. Means for hanging the ornament is attached to the ball along the juncture while the bell is hung from its top. The ornament is at least partly filled with a fire retardent powder. Inside the ornament is a spring compressed between the two pieces. When the ornament is exposed to an elevated temperature the adhesive melts, the spring forces the pieces apart and the fire retardant is spread on the source of heat below.

BACKGROUND OF THE INVENTION

An important advantage of the present invention is its ease of operation and thus its infallibility of operation. The prior art fire extinguishing ornaments use a complicated triggering mechanism which must function to open a valve such as in B. E. Boyce, U.S. Pat. No. 2,876,845, or shatter a part or all of the ornament such as in L. E. Doak, U.S. Pat. No. 2,871,952, L. C. Deyo, E.S. U.S. Pat. No. 2,522,020 or G. C. Pappas, U.S. Pat. No. 2,682,310. Still other devices, by their design are constructed of heavy or bulky materials as they contain a gaseous material or a liquid which vaporizes as low temperature such as shown in J. H. Reger, U.S. Pat. No. 2,522,962 and W. J. Korth et al, U.S. Pat. No. 2,508,676. B. W. Barr, U.S. Pat. No. 3,171,493, also uses a pressurized extinguishing ornament but this device utilizes a completely separate cartridge containing the extinguishing gas linked to the ornament by tubing. The Lehder device, U.S. Pat No. 2,800,187 must drop and shatter to function. Pettier, U.S. Pat. No. 3,132,695, shows a trigger device which must actually ignite for the extinguishing ornament to function.

BRIEF DESCRIPTION

The unique features of the invention are shown in the accompanyng figures and more fully described below.

DESCRIPTION OF A PREFERRED EMBODIMENT

Figure 1:
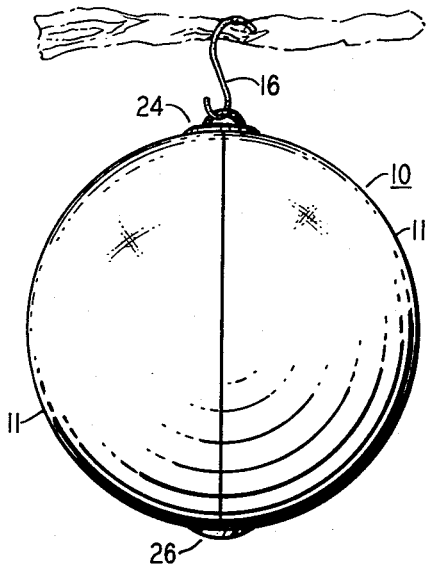
FIG. 1 is a view of the fire extinguishing ornament in the shape of a ball mounted on a tree.
Figure 2:
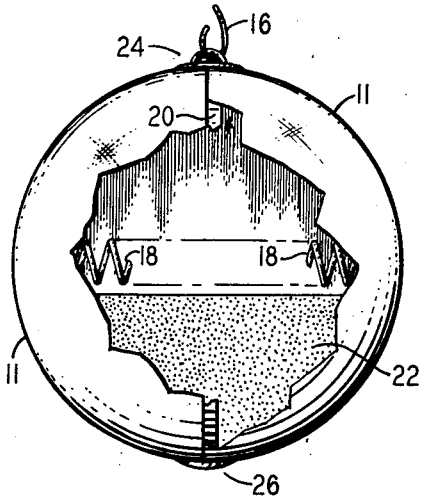
FIG. 2 is a view of the fire safety Christmas ball as it appears prior to being activated.
Figure 3:
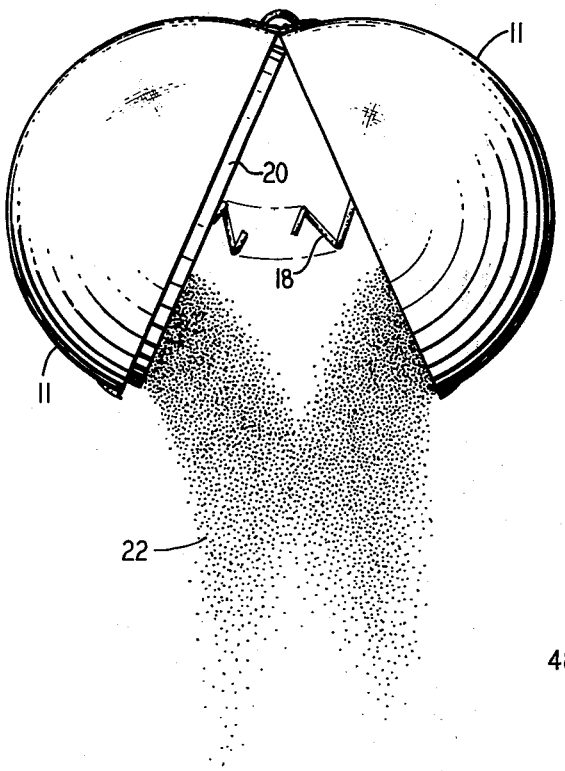
FIG. 3 is a view of the same device as it is being activated by a source of elevated temperature.

Referring now to FIGS. 1-3 the fire extinguishing ornament 10 consists of a hollow sphere made of two halves or shells 11. Attached to one of the shells and at the edge thereof is a means 16 for hanging the ornament on a tree or Christmas decoration. The means 16 may be a loop for attaching a hanger or hook or it may itself be a hook. When hung the means 16 is at the top of the ornament or, in the case of a spherical ornament, the north pole 24 thereof. When the two shells 11 are mated the point of juncture proscribes a line from the top 24 to the bottom 26 (or north to south pole) of the ornament. So that the shells 11 can be readily joined one of the shells has a lip 20 around its edge. The outer diameter of the lip 20 of this shell is just less than the inner diameter of the mating portion of the other shell 11.

When joined the shells 11 form a hollow ornament. Inside the hollow ornament is a compressed spring 18 positioned such that the pressure of the spring tends to separate the two shells or halves 11. The inside of the ornament is also partly filled with a powdered fire extinguishing material 22 such as borates or ammonium nitrate. The shells 11 containing the powdered fire extinguishing material 22 and compressed spring 18 is held in their joined position by a hot melt adhesive applied at at least two points along the juncture of the shells, the adhesive points preferably 180° apart. It is preferred that the adhesive is a hot melt glue or a wax that softens at greater than 100° F. In the preferred embodiment one drop of adhesive is applied at the bottom or south pole 26 of the sphere while a second drop of adhesive is applied at the top, or north pole 24 of the ornament. As an alternative a hinging means is attached to the top of the ornament in place of the adhesive.

Alternate Embodiment

Figure 4:
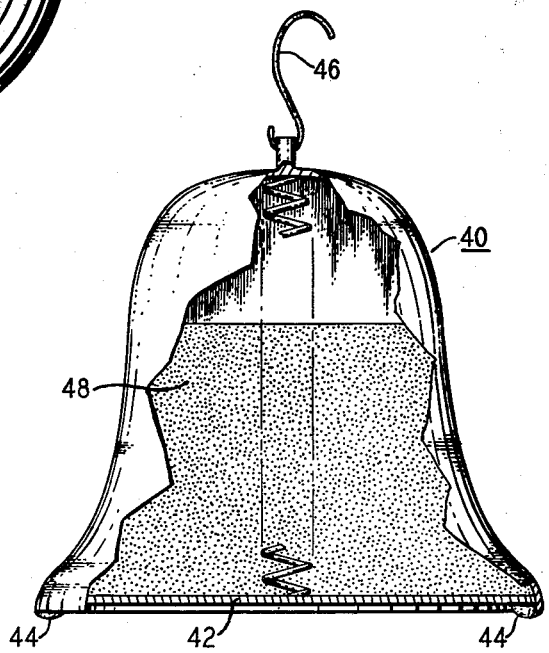
FIG. 4 is a view of a second embodiment of the fire extinguishing ornament.

The embodiment of FIG. 4 operates basically in the manner of the previously described embodiment. The ornament consists of a bell shaped outer structure, a closure means 42 covering the opening in the bell 40, said closure means 42 sealingly adhered to the ornament by a hot melt glue or adhesive at at least 2 points 44, these points preferably positioned the maximum distance from each other along the juncture of the bell 40 and closure 42.

Attached to the top of the bell is a hanging means 46, such as a hook or loop. Located inside the ornament is a compressed spring positioned to bias the closure 42 away from contact with the bell. The remainder of the inside of the bell is partly or totally filled with a fire extinguishing powder 48.

In use one or more of the ornaments 10 and/or 40 are hung on a Christmas tree. Should the tree catch fire, even if an elevated temperature is caused by an insipient smoldering fire the adhesive will melt and in the first embodiment the spring 18 inside the ornament will force the shells 11 apart as shown in FIG. 3. In the case of the bell shaped embodiment the spring forces the bottom off. The fire extinguishing powder will then be released from the interior of the ornament to fall on the source of heat below.

As the present invention can be incorporated into numerous different shapes it is clear that the embodiments described are merely representative. It is necessary only to use a hollow ornament composed of at least two pieces, the pieces joined at two spaced apart points by a low temperature melting adhesive, filled with a powdered extinguishing material, the parts being biased away from each other by a compressed spring located inside the hollow ornament. Heat of a fire melts the adhesive allowing the springs to separate the ornament pieces thus dispensing the extinguishing powder.

What I claim as my invention is:

1. A decorative fire extinguishing tree ornament comprising a hollow two piece structure, the two pieces attached at spaced apart points along their juncture by a hot melt adhesive which softens at a temperature greater that 100° F., at least one hinge-like structure located at the top of said ornament and joining said two pieces, a compressed spring positioned inside the ornament, each end of said spring contacting a portion of each of the pieces and tending to force the pieces apart, a single means at the top of the ornament at the juncture of the two pieces for suspending said ornament on a tree limb, said ornament containing a fire extinguishing powder.

2. The ornament of claim 1 wherein the two pieces are each spherical halves of a globe.

3. The ornament of claim 1 wherein the fire extinguishing powder is chosen from the group consisting of borates and ammonium nitrate.

4. The ornament of claim 1 wherein the hot melt adhesive is a wax.

5. The ornament of claim 1 wherein the hot melt adhesive is a hot melt glue.

* * * * *